US007938270B2

(12) United States Patent
Davis

(10) Patent No.: US 7,938,270 B2
(45) Date of Patent: May 10, 2011

(54) GIFT CARD PRESENTER

(75) Inventor: Paul P. Davis, Grand Rapids, MI (US)

(73) Assignee: Access Business Group International LLC, Ada, MI (US)

( * ) Notice: Subject to any disclaimer, the term of this patent is extended or adjusted under 35 U.S.C. 154(b) by 216 days.

(21) Appl. No.: 12/348,041

(22) Filed: Jan. 2, 2009

(65) Prior Publication Data

US 2010/0170822 A1 Jul. 8, 2010

(51) Int. Cl.
*B65D 25/00* (2006.01)
*B31B 1/26* (2006.01)

(52) U.S. Cl. ..... 206/768; 206/449; 206/757; 206/760; 206/765; 493/162

(58) Field of Classification Search ..... 206/449, 206/486, 488, 489, 737, 738, 756, 757, 759, 206/760, 763–765, 767, 768, 774; 40/124.08; 235/380, 486; 493/162
See application file for complete search history.

(56) References Cited

U.S. PATENT DOCUMENTS 3,549,225 A * 12/1970 Scaccia ..... 206/312
4,949,482 A * 8/1990 Price ..... 40/124.08
5,479,732 A * 1/1996 Burtch et al. ..... 40/124.16
5,641,063 A * 6/1997 Gambardella et al. ..... 206/312
6,386,370 B1 * 5/2002 Wigton et al. ..... 206/763
6,505,737 B1 * 1/2003 Sherman ..... 206/312
6,640,974 B2 * 11/2003 Malone ..... 206/449
2005/0258060 A1 * 11/2005 Katz ..... 206/425

OTHER PUBLICATIONS

Up with Paper, LLC, Treasures, Pop-Up Greeting Card, 888GC Holiday Gift Card Holder, http://www.upwithpaper.com/treasures.html, Oct. 18, 2004.
Vida Valencia, Gift Card Presenters, The Original Gift Card Pop-Upz Collection, 2007 Gfit Card Presenters, http://www.vidavalencia.com/200_products.htm, Mar. 2, 2007.

* cited by examiner

*Primary Examiner* — Luan K Bui
(74) *Attorney, Agent, or Firm* — Warner Norcross & Judd LLP

(57) ABSTRACT

A gift card presenter includes a base portion folded along a fold line and having an inner and outer surface. A support portion is folded along a fold line and includes opposite ends on either side of the support portion fold line, which are secured to the inner surface of the base portion on opposite sides of the base portion fold line. The support portion defines an opening adapted to receive and support a card, which travels through the opening until it engages the base portion. The unfolding of the base portion causes the support portion to unfold and move toward the base portion, which forces the card back through the opening and outward from the support portion, thus creating a pop-up effect.

19 Claims, 8 Drawing Sheets

GIFT CARD PRESENTER

BACKGROUND OF THE INVENTION

The present invention relates generally to gift cards, and more particularly to holders for gift cards.

Gift cards are a type of gift certificate issued by a retailer or restaurant or the like. However, instead of a paper gift certificate, a gift card is issued in the form of a prepaid debit card. Gift cards are extremely popular gifts, as they relieve the giver of the burden of selecting a specific item of the right size or according to the particular tastes of the recipient. Yet a gift card is more personal than cash or a check, because the giver is able to select a store at which the giver knows the recipient enjoys shopping or a restaurant at which the recipient enjoys eating.

As noted above, gift cards are often issued in the form of a prepaid debit card, having a magnetic strip or bar code on the back. The cards are uniformly shaped and sized like credit cards, the dimensions of which are governed by an international standard. Occasionally, the retailer or restaurant that issues the gift card will provide a holder for the card, often in the form of a paper or cardboard backing that is glued to the card. However, the glue that is used is often hard to remove from the card. Alternatively, the retailer or restaurant may provide a holder that has four tabs or slots to retain the corners of the card. However, it can be difficult to secure the corners of the gift card under the tabs or into the slots in the holder. Further, these types of holders are not reliable, because the corners of the gift card can easily slip out.

Moreover, any type of gift card holder provided by a retailer or restaurant will typically have only the store's or restaurant's name and/or logo on it. Thus, the giver must still provide a separate greeting card for the recipient, for example, a birthday or Christmas card. Because the separately purchased greeting card is not adapted to hold or retain the gift card, the gift card can easily slide out of the greeting card when the recipient opens it. Alternatively, the giver can wrap the gift card itself, which can be difficult because of the small size of the gift card.

SUMMARY OF THE INVENTION

The present invention provides a gift card presenter that uniquely displays a gift card, or similarly sized item, to a recipient.

According to one embodiment, a gift card presenter includes a base portion folded along a fold line and having inner and outer surfaces. A support portion is folded along a fold line and has opposite ends on either side of the support portion fold line, which are secured to the base portion on opposite sides of the base portion fold line. The inner surface of the support portion faces the inner surface of the base portion. The support portion defines an opening adapted to receive and support a card, which extends through the opening and engages the base portion. The opening of the base portion by unfolding it along its fold line causes the support portion to unfold and travel toward the base portion, which presses the card through the opening and outward from the support portion.

Optionally, the opening may be positioned along the support portion fold line, which may be aligned with the base sheet fold line. Further, a line of weakening, such as a perforation or a living hinge, may be included on the support portion fold line.

According to another embodiment, a gift card presenter is formed from a single sheet having first, second, third, fourth and fifth fold lines and having inner and outer surfaces. The sheet also has a first end adjacent the first fold line and a second opposite end adjacent the fifth fold line. The portion of the sheet between the first end and the second fold line defines a base portion. The portion of the sheet between the second and third fold lines is folded along the second fold line and secured over the inner surface of the base portion. The portion of the sheet between the fifth fold line and said second free end is positioned over the inner surface of the base portion, between the first fold line and the first end, and is secured thereto. The portion of the sheet between said third and fifth fold lines forms a support portion that is not secured to the base portion and that defines an opening adapted to receive and support a card. The card can be inserted through the opening until the card engages the base portion. When the base portion unfolds, the support portion unfolds and travels toward the base portion, which forces the card out of the opening and outward from the support portion.

Thus, the gift card presenter of the present invention combines the functionality of a gift card holder with the flair of a pop-up greeting card. A gift card can be easily inserted into and removed from the card presenter, yet the card presenter is adapted to securely retain the gift card to prevent it from sliding out. Further, the front and inner portions of the card presenter can function as a greeting card, thus eliminating the need for the giver to either purchase a separate greeting card or to wrap the gift card itself. Additionally, the gift card presenter can be easily and inexpensively manufactured from one single sheet.

These and other objects, advantages, and features of the invention will be more fully understood and appreciated by reference to the description of the current embodiment and the drawings.

DESCRIPTION OF THE CURRENT EMBODIMENT

I. Structure

Figure 1:
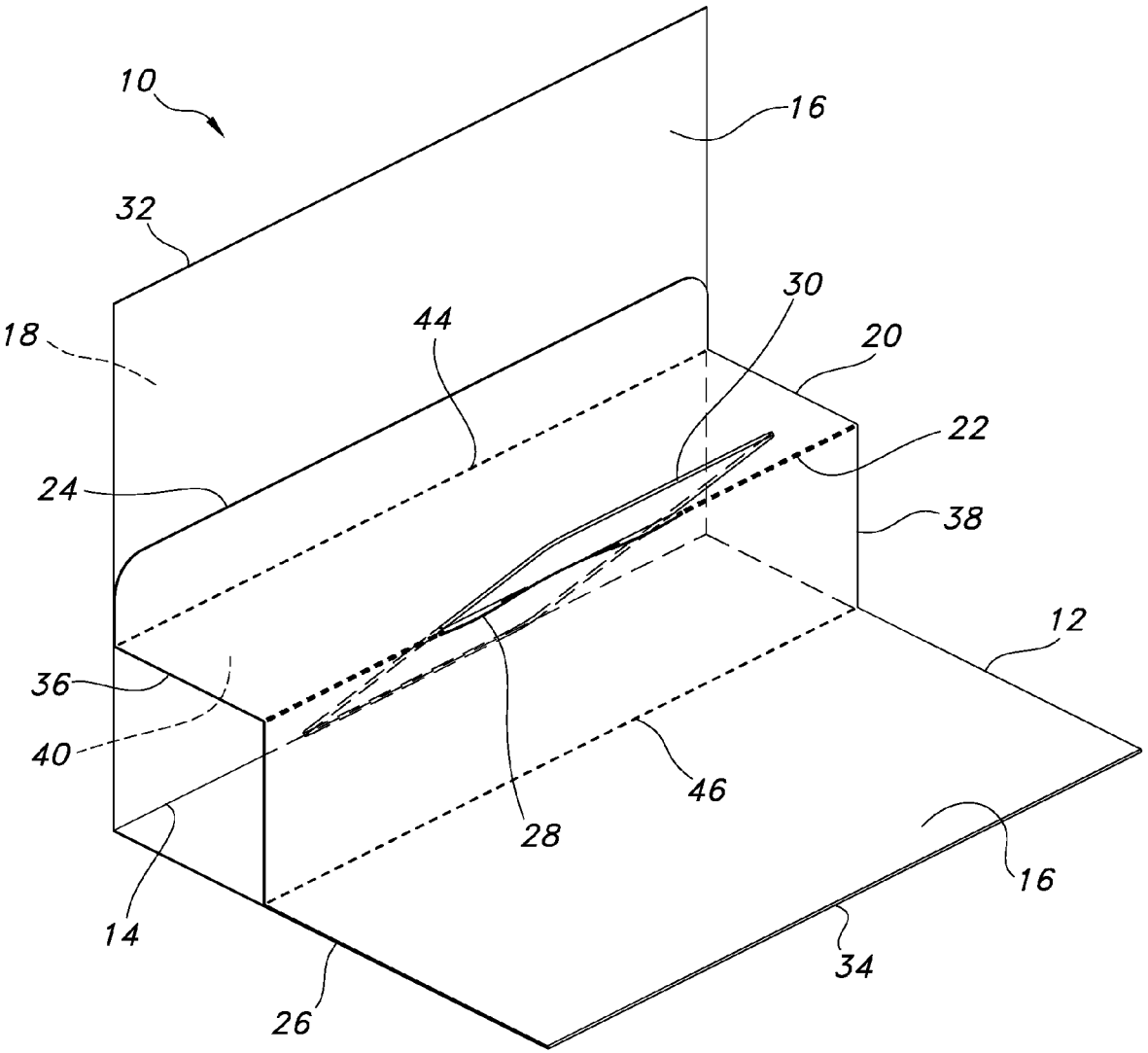
FIG. 1 is a perspective view of a gift card presenter in accordance with the present invention.
Figure 2:
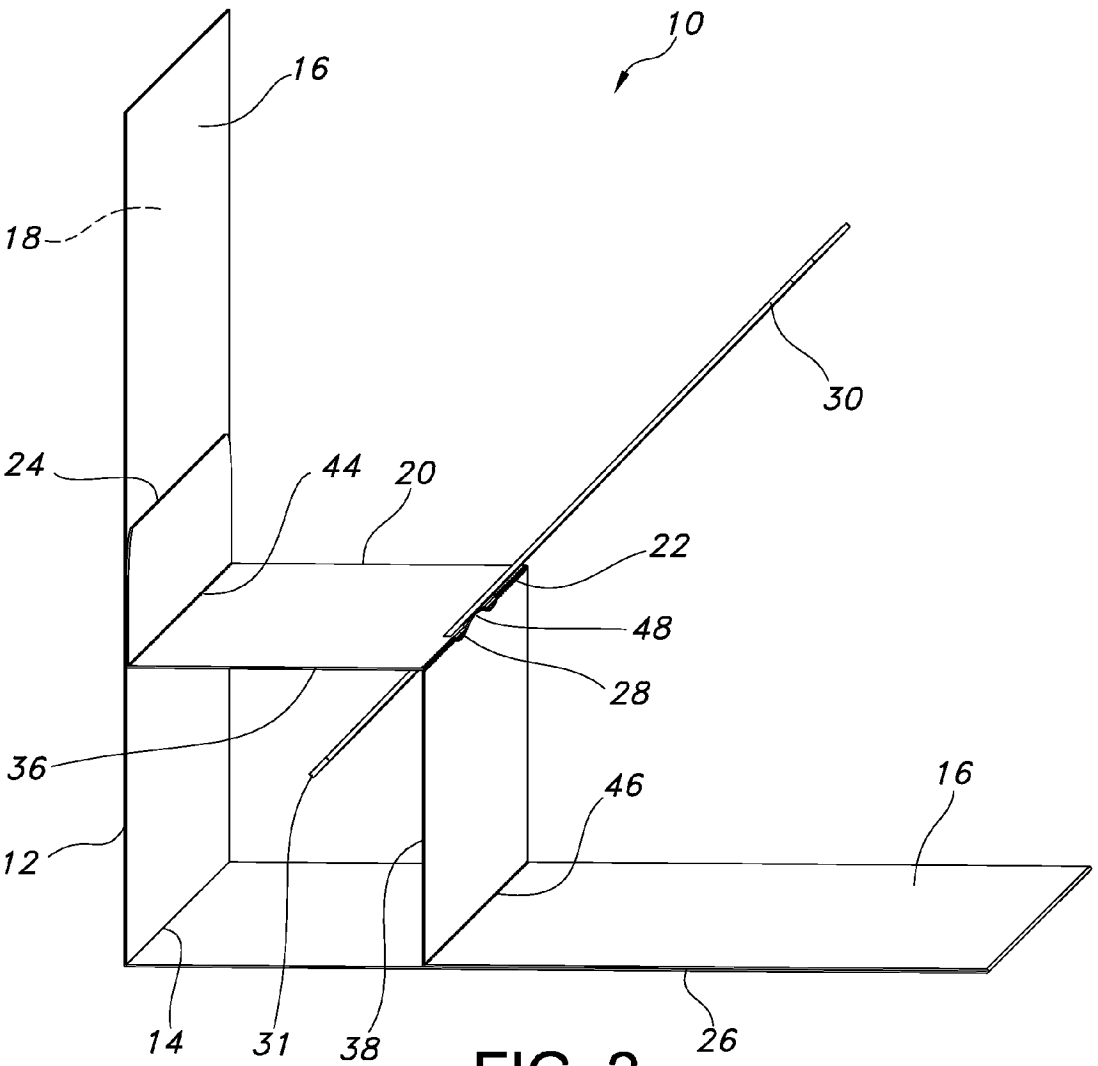
FIG. 2 is a perspective view of the gift card presenter of FIG. 1, with a card partially inserted into the presenter.
Figure 3:
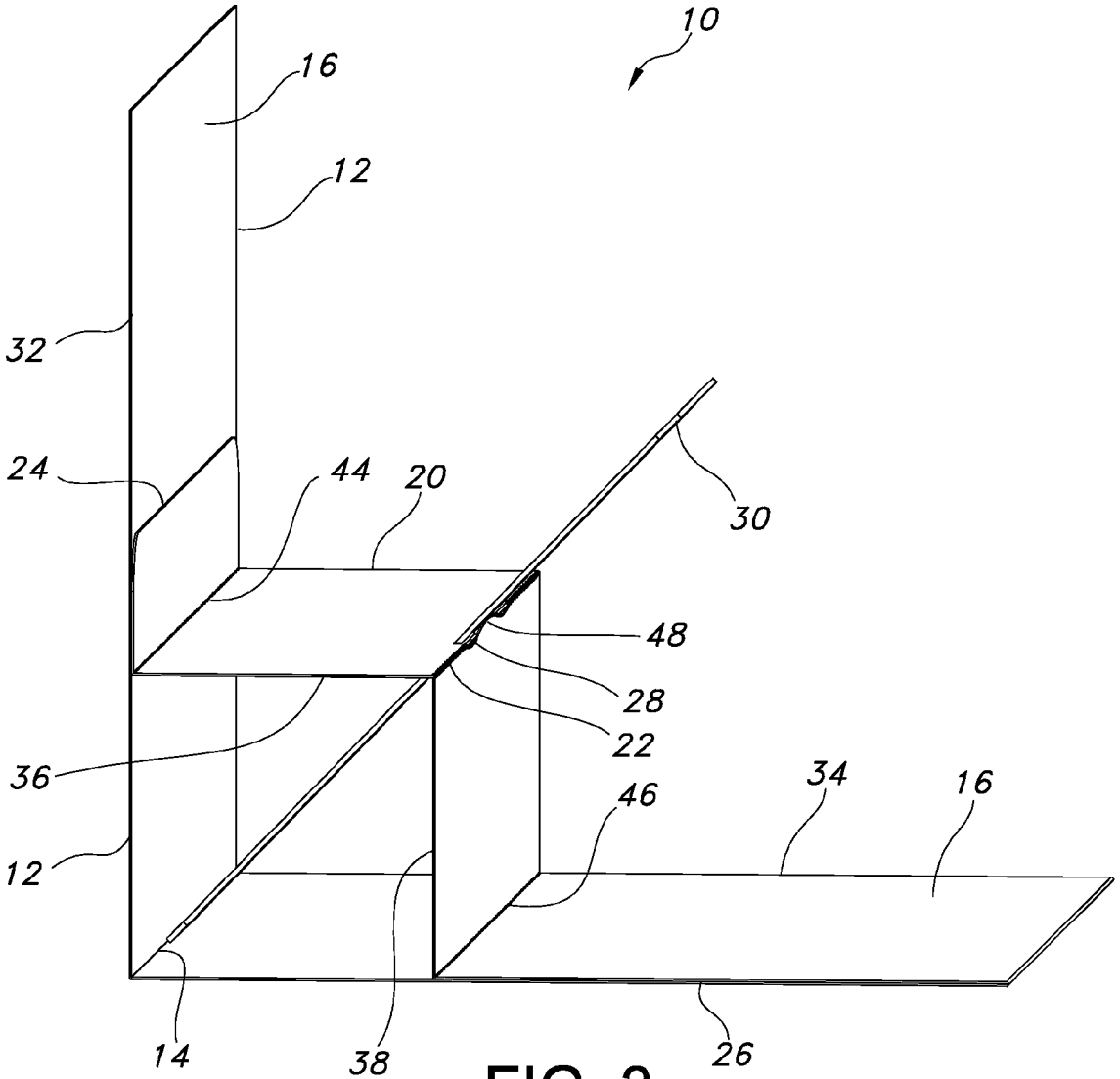
FIG. 3 is a perspective view of the gift card presenter of FIG. 1, with a card fully inserted into the presenter.

A gift card presenter in accordance with the present invention is shown in FIG. 1 and is generally designated 10. The card presenter 10 includes a base portion 12, which is folded along a crease or fold line 14 and includes an inner surface 16 and an outer surface 18. The card presenter 10 also includes a support portion 20 that is folded along a crease or fold line 22 and has opposite ends 24, 26 on either side of the fold line 22. The ends 24 and 26 of the support portion 20 are secured to the inner surface 16 of the base portion 12 on opposite sides of the fold line 14, respectively, with the inner surface 40 of the support portion 20 facing the inner surface 16 of the base portion 12. The support portion 20 includes a receptacle or opening 28 that can receive and support a card 30, such as a gift card or prepaid debit card or the like. The card 30 can be pushed or guided into and through the opening 30 in the support portion 20 until the card engages the base portion 12 (FIGS. 2 and 3). The card presenter 10 is typically given to a recipient in a folded position, and when the recipient unfolds the base portion 12, the unfolding of the base portion 12 causes the support portion 20 to unfold and travel toward the base portion 12, which forces the card 30 out of the opening 28 and away from the support portion 20.

The base portion 12 can be formed in any suitable shape and size. In the illustrated embodiment, the base portion 12 of the card presenter 10 is generally rectangular, with the fold line 14 running transversely across the width of the base portion 12. The fold line 14 is positioned in the middle of the base portion 12 and divides the base portion 12 into two generally equal halves 32 and 34, such that the halves 32 and 34 are aligned when the base portion is folded closed. The base portion 12 is adapted to fold closed until the inner surfaces of the halves 32 and 34 engage each other.

Figure 5:
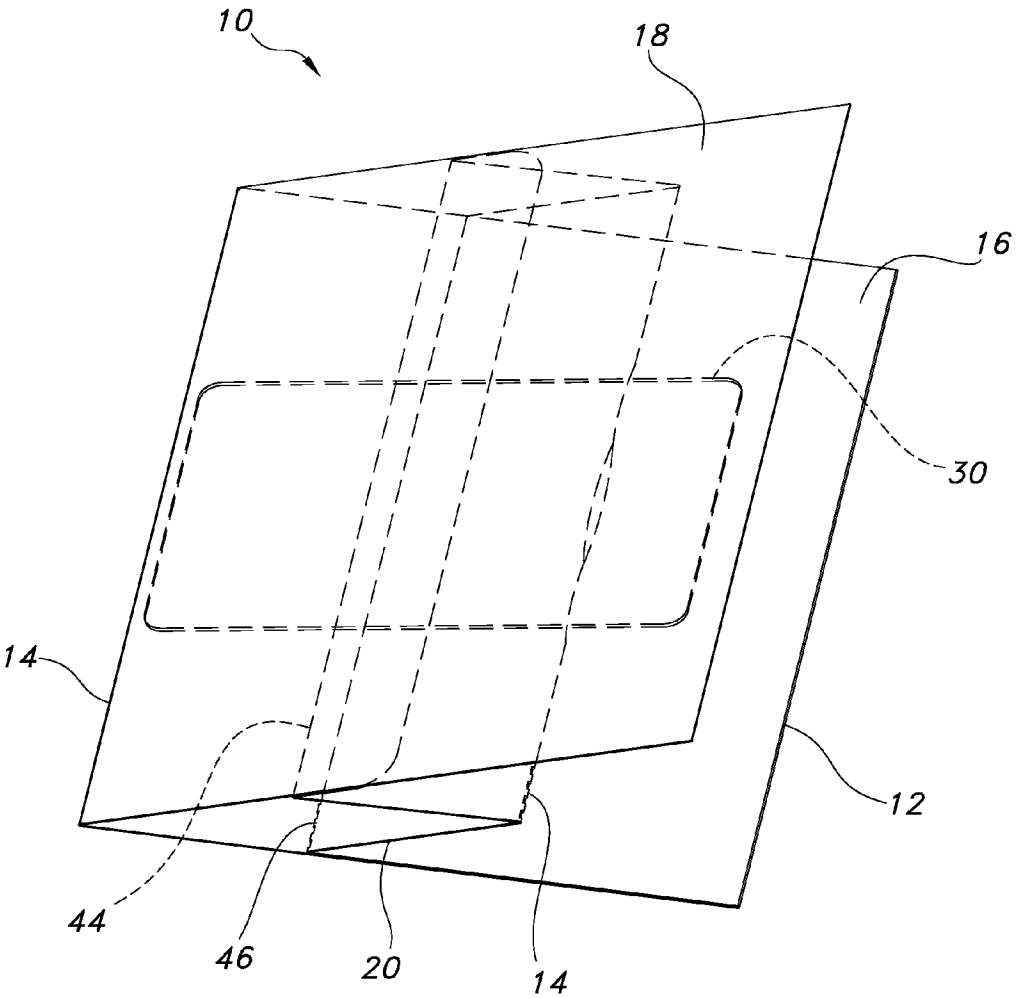
FIG. 5 is a perspective view of the gift card presenter of FIG. 1 in a nearly closed position.

The support portion 20 can be formed separately from or integrally with the base portion 12, as will be discussed in more detail below. The support portion 20 can configured in any size and shape that is suitable to support the card 30. In the illustrated embodiment, the support portion 20 is generally rectangular and has a width that corresponds with the width of the base portion 12. Alternately, the support portion 20 can have a shorter width than the base portion 12, as the support portion 20 need only be wide enough to receive and support the card 30. In the illustrated embodiment, the length of the support portion 20 is shorter than that of the base portion 12, such that the base portion 12 can fully conceal the support portion 20 and the card 30 when the base portion 12 is folded closed (FIG. 5). Thus, the gift card 30 and its outward movement toward the recipient remain a surprise until the card presenter 10 is opened.

In the illustrated embodiment, the fold line 22 runs transversely across the width of the support portion 20 and divides the support portion 20 into two sections 36 and 38. The fold line 22 is generally aligned with the fold line 14 of the base portion 12, such that the support portion 20 is generally centered with the base portion 12. In the illustrated embodiment, the ends 24 and 26 of the support portion 20 are each secured to the base portion 12 at a generally equal distance from the fold lines 14 and 22, such that the sections 36 and 38 of the support portion 20 are aligned when the base portion 12 is folded closed. Alternatively, the ends 24 and 26 could be secured to the base portion 12 at different positions, which may result in the card extending from the support portion 20 at a different angle.

As noted above, the inner surface 40 of the support portion 20 faces the inner surface 16 of the base portion 12, such that the fold line 22 of the support portion 20 and the fold line 14 of the base portion 12 are facing opposite directions. The support portion 20 is not connected or secured to the base portion 12 between the ends 24 and 26. Thus, the fold lines 14 and 22 are able to extend outwardly from each other when the card presenter 10 is folded closed and draw closer to each other when the card presenter 10 is unfolded. Optionally, the support portion 20 may include a line of weakening along the fold line 22. For example, the line of weakening may be a perforation or a living hinge that allows the support portion 20 to more easily fold or bend along the fold line 22 when the card presenter 10 is opened and closed.

In the illustrated embodiment, the card presenter 10 is configured to create a "pop-up" or three-dimensional effect when it is opened. Specifically, the unfolding of the base portion 12 causes the ends 24 and 26 of the support portion 20 to be forced apart, which creates a space between the sections 36 and 38 of the support portion 20 and the base portion 12, thus creating the appearance that the support portion 20 "pops" outward from the base portion 12. For example, as shown in FIGS. 1-3, when the base portion 12 is folded along fold line 14 at a generally 90 degree angle, the support portion 20 is also folded along fold line 22 at a generally 90 degree angle, extending outward from the base portion 12. Thus, in the illustrated embodiment, the support portion 20 mirrors the folding motion of the base portion 12.

Figure 4:
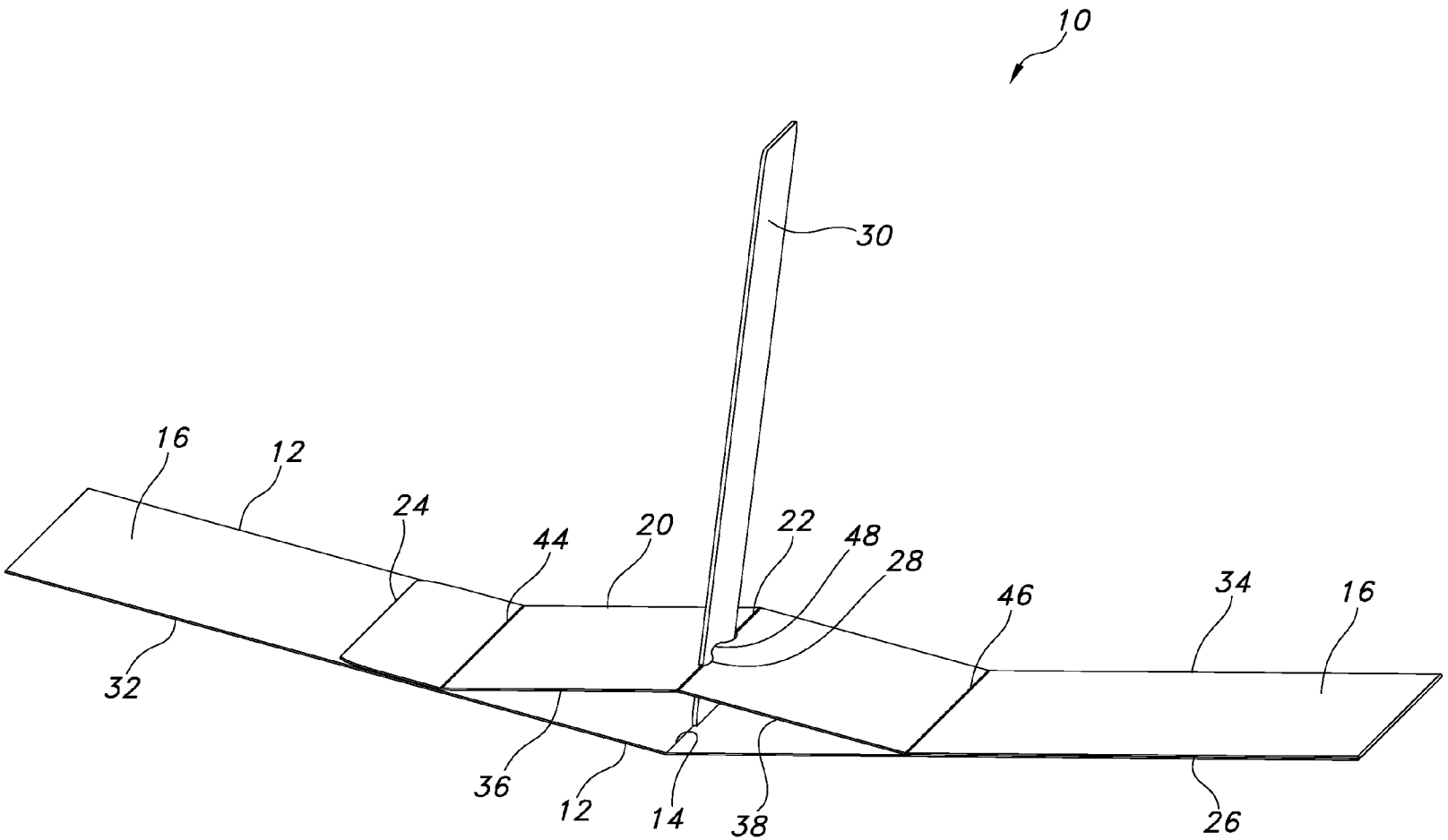
FIG. 4. is a perspective view of the gift card presenter of FIG. 1 in a nearly fully extended position.

An additional pop-up or three-dimensional effect is created by the movement of the card 30 away from the support portion 20 when the base portion 12 is unfolded. In the illustrated embodiment, as shown in FIG. 4, as the ends 24 and 26 of the support portion 20 are stretched further apart, the sections 36 and 38 of the support portion 20 are forced toward the base sheet 12, which reduces the space between the fold lines 14 and 22. The base portion 12 engages the end 31 of the card 30 to maintain the position of the card 30 with respect to the base portion 12, while the unfolding motion of the base portion 12 pulls the support portion 20 down about the card 30 to force the card 30 back through the opening 28. Thus, the card 30 appears to "pop" out at the recipient.

The ends 24, 26 of the support portion 20 can be secured to the base portion 12 in any suitable manner. Optionally, at least one of the ends 24, 26 of the support portion 20 is formed as a flange portion that is overlapped with and secured to the inner surface 16 of the base portion 12. The flange portions 24 and 26 may be secured to the base portion 12 in any suitable manner, including but not limited to adhering, stapling and/or any other suitable means of connection. Each of the flange portions 24 and 26 have an inner edge 44, 46, respectively, where the support portion 20 separates from the base portion 12. Optionally, a line of weakening may be included along the inner edges 44, 46 of the flange portions 24 and 26 to allow the support portion 20 to more easily bend or fold at the flange portions 24, 26 when the card presenter 10 is opened and closed.

Both the length of the support portion 20 and the position of the support portion 20 on the base portion 12 may limit the range of the folding motion of the base portion. In the illustrated embodiment, the support portion 20 is of sufficient length and is secured to the base portion 12 at a position close enough to the fold line 14 to allow the base portion 12 to unfold until the base portion 12 is generally flat, such that there is a generally 180 degree angle between the halves 32 and 34 of the base portion 12. When the base portion 12 reaches the generally flat position, the support portion 20 is taut, such that the base portion 12 cannot unfold any further without disconnecting or ripping an end 24 or 26 of the support portion 20 from the base portion 12. Alternatively, the support portion 20 can be sized and secured to the base portion 12 to further limit the range of motion of the base portion 12 or to allow the base portion 12 a greater range of folding motion.

The receptacle or opening 28 in the support portion 20 can be sized and shaped to accommodate any type of gift card, prepaid debit card, credit card, or the like. The size and shape of most, if not all, of these types of cards is governed by an international standard, such that the card presenter 10 can accommodate a card 30 from a variety of sources. In the illustrated embodiment, the size of the opening 28 corresponds to the width of the card 30, such that the opening 28 is adapted to receive the card 30 in a vertical orientation. Alternatively, the opening 28 can correspond to the length of the card 30, such that the opening 28 can receive the card 30 in a horizontal orientation. Optionally, the support portion 20 could be configured to receive the card 30 in a diagonal orientation. In the illustrated embodiment, the opening 28 is positioned along the fold line 22 of the support portion 20. Because the fold line 22 of the support portion 20 and the fold line 14 of the base portion 12 are generally aligned, the card 30 engages the base portion 12 along the fold line 14 (FIGS. 1 and 3).

Optionally, an edge of the opening 28 can be contoured to better retain the card 30. For example, as best shown in FIGS. 2 and 3, the edge of the opening 28 is wave-shaped, with tab-like projections 48 formed around the edge of the opening. The projections 48 are formed on both sides of the card 30 to securely retain the card 30 in the opening 28 and to prevent the card 30 from sliding out of the card presenter 30. In fact, the card 30 may be so securely retained in the opening 28 that a bottom edge 31 of the card need not be supported by the base portion 12 (FIG. 2). However, the card 30 is not secured so tightly that it is prevented from being pushed further through the opening 28 or back through the opening 28 when the card presenter 10 is opened.

Optionally, the card presenter 10 may include printing on the base portion 12 and/or the support portion 20. For example, the base portion 12 can function as a greeting card, with the outer surface 18 of the first half 32 of the base portion 12 forming the front of the greeting card and the inner surface 16 of the base portion 12 forming the inside of the greeting card. Having the card presenter itself function as a greeting card eliminates the need for the giver to either purchase a separate greeting card or to wrap the gift card. Alternatively, the retailer or restaurant that issues the gift card 30 may include their logo or name on the base portion 12 and/or the support portion 20, to convey to the recipient where the gift can be redeemed. The card presenter of the present invention can be formed from any suitable material, including card stock, plastic or the like.

II. Method

Figure 6:
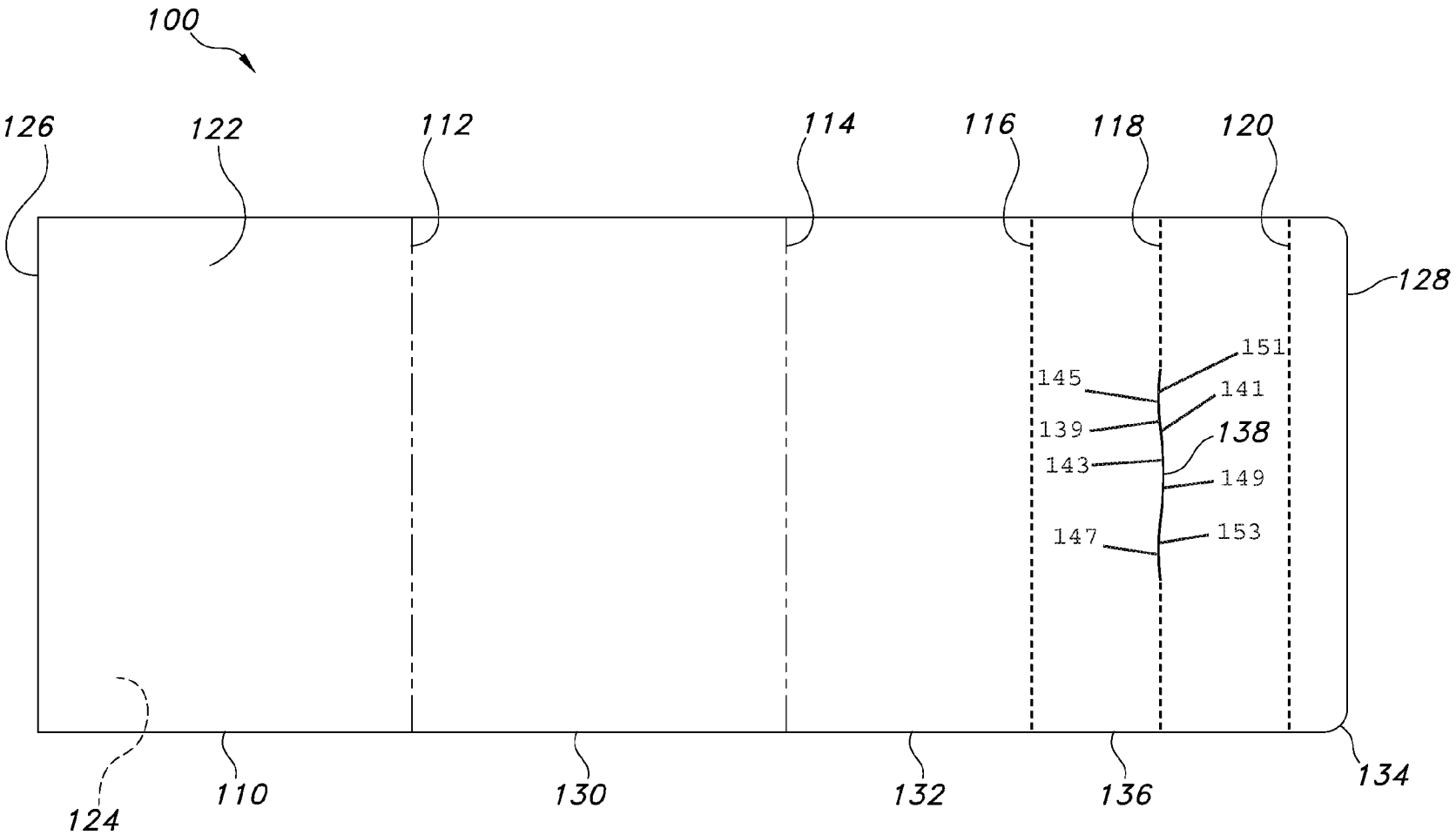
FIG. 6 is a top plan view of a sheet that can be formed into a gift card presenter in accordance with the present invention.
Figure 7:
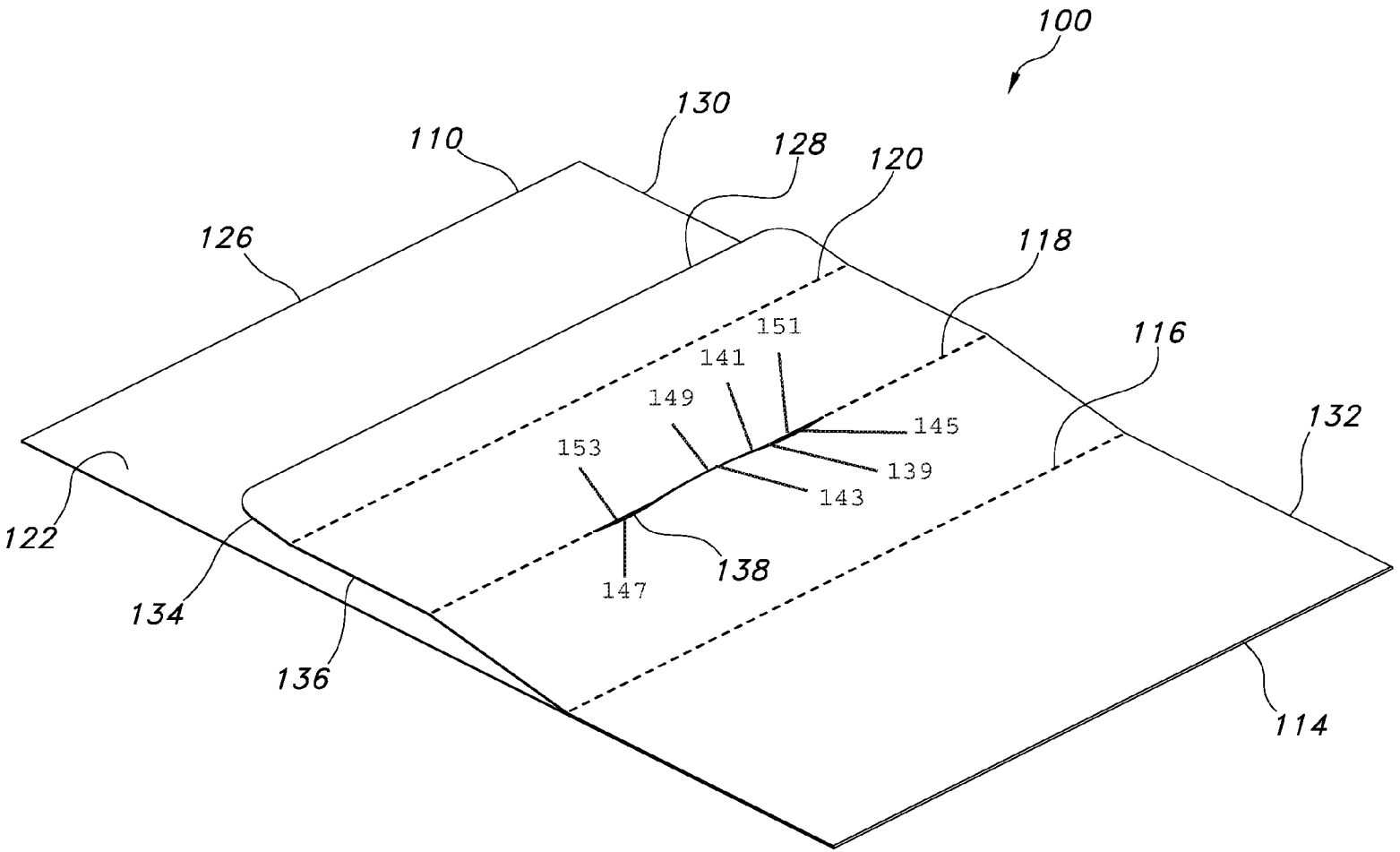
FIG. 7 is a perspective view of the sheet of FIG. 6, with a portion of the sheet being folded.
Figure 8:
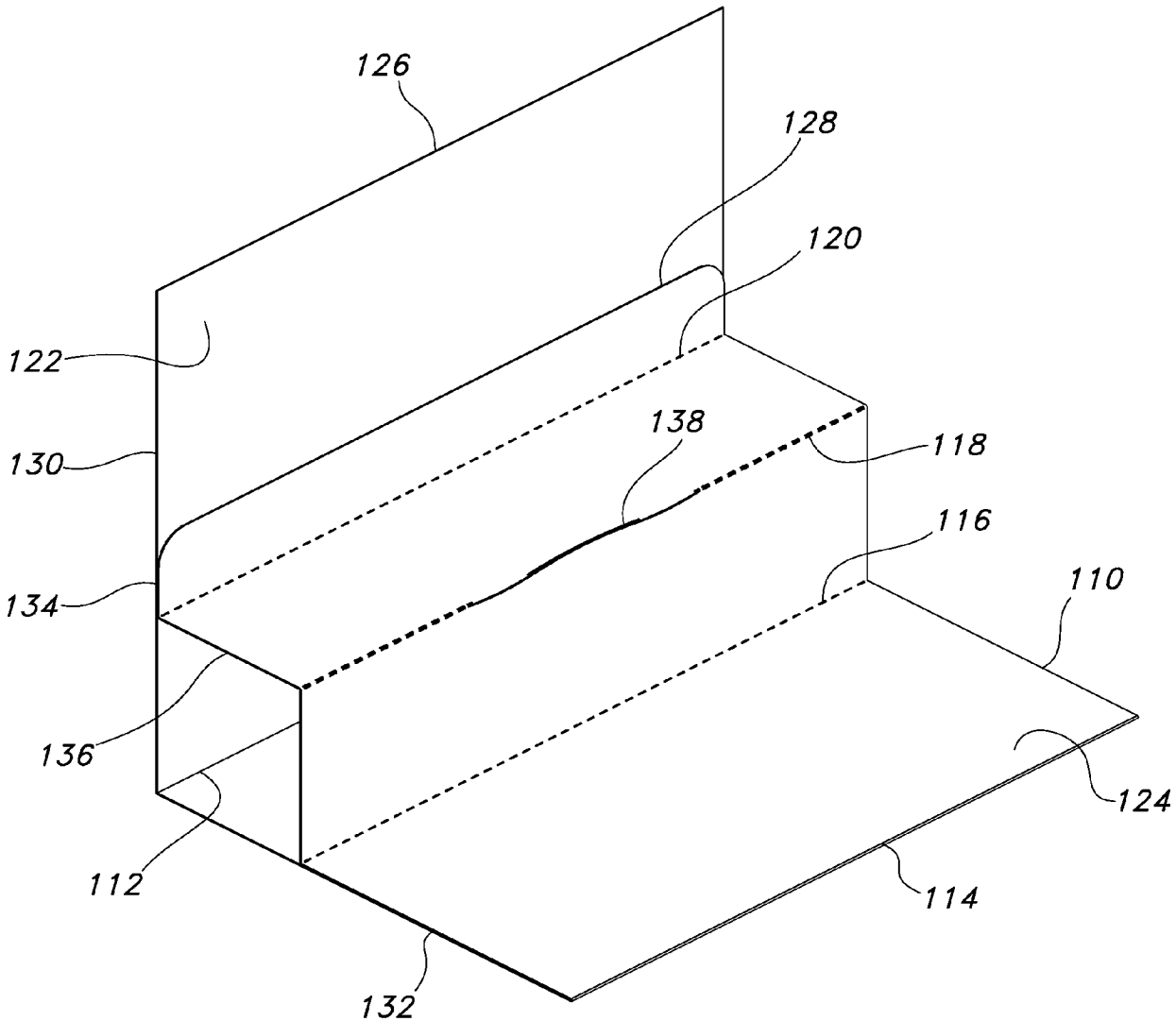
FIG. 8 is a perspective view of a gift card presenter in accordance with the present invention, formed from the sheet of FIG. 6.

Optionally, a card presenter in accordance with the present invention may be formed from a single sheet. As shown in FIGS. 6-8, a gift card presenter 100 is formed from a single sheet 110 having first, second, third, fourth and fifth fold lines 112, 114, 116, 118 and 120, respectively, and having an inner surface 122 and an outer surface 124 (FIG. 6). The sheet 110 has an end 126 adjacent the first fold line 112 and an opposite end 128 adjacent the fifth fold line 120. A portion 130 of the sheet 110 between the first end 126 and the second fold line 114 defines a base portion 130.

A first overlapped portion 132 of the sheet 110 between the second fold line 114 and the third fold line 116 is folded along the second fold line 114 to overlap the inner surface 122 of the base portion 130 (FIG. 7). The first overlapped portion 132 is secured to the inner surface 122 of the base portion 130. In the illustrated embodiment, the overlapped portion 132 does not reach the first fold line 112 of the base portion 130.

A second overlapped portion 134 of the sheet 110 between the fifth fold line 120 and the end 128 is overlapped with and secured to the inner surface 122 of the base portion 130 between the end 126 and the first fold line 112. As shown in FIG. 8, the overlapped portions 132 and 134 define a support portion 136 between the third fold line 116 and the fifth fold line 120, which is not secured to the base portion 130. The support portion 136 is adapted to fold along the third, fourth and fifth fold lines to collapse when the base portion 130 is folded closed.

The support portion 136 defines an opening 138 that is adapted to receive and support a gift card, debit card, credit card or the like, as shown in FIGS. 1-4, which were discussed above with respect to gift card presenter 10. As described above, the card travels through the opening 138 until it engages the base portion 130. When the base portion 130 unfolds, the support portion 136 unfolds and travels toward the base portion 130, which forces the card out of the opening 138. As shown in FIGS. 6 and 7, the opening 138 formed in the support portion 136 along fold line 118 may have a continuously curving wave-shape, forming a pair of opening edges 139, 141 with opposing wave-shapes that cooperate with each other to securely retain the gift card between the edges 139, 141. In one embodiment, the first opening edge 139 includes a central wave crest 143 which is flanked on either side by troughs 145 and 147. The second opening edge 141 has generally the opposite shape of the first opening edge 139, such that the second edge 141 includes a central trough 149 flanked by crests 151 and 153.

The card presenter 100 may be substantially similar to the gift card presenter 10 described above. Additionally, in the illustrated embodiment, the fold lines 112, 114, 116, 118 and 120 are all oriented transversely across the width of the sheet 110. Optionally, the third, fourth and/or the fifth fold lines 116, 118 and 120, respectively, may include a line of weakening, which may be a perforation or a living hinge. The living hinges may allow the support portion 136 to more readily fold and collapse when the card presenter 100 is opened and closed.

The above description is that of the current embodiment of the invention. Various alterations and changes can be made without departing from the spirit and broader aspects of the invention as defined in the appended claims, which are to be interpreted in accordance with the principles of patent law including the doctrine of equivalents. Any reference to claim elements in the singular, for example, using the articles "a," "an," "the" or "said," is not to be construed as limiting the element to the singular.

The embodiments of the invention in which an exclusive property or privilege is claimed are defined as follows:

1. A gift card presenter, comprising:

a base portion folded along a fold line and having an inner surface and an outer surface;

a support portion folded along a fold line and having an inner surface and an outer surface, said support portion having opposite ends on either side of said support portion fold line, wherein said ends of said support portion are secured to said base portion on opposite sides of said base portion fold line, wherein said inner surface of said support portion faces said inner surface of said base portion;

wherein said support portion includes an opening adapted to receive and support a card, wherein said card is adapted to travel through said opening and engage said base portion;

wherein said base portion and said support portion are configured so that the unfolding of said base portion causes said support portion to unfold and to travel toward said base portion, wherein said base portion forces said card to move at least partially out of said opening and outward from said support portion, wherein said base portion has a greater length than said support portion, wherein said base portion is adapted to fully conceal said support portion and said card when said base portion is folded closed; and wherein said opening includes a pair of opening edges that cooperate with each other to securely retain said card between said edges, each said opening edge having a continuously curving wave-shape.

2. The gift card presenter of claim 1, wherein said opening is positioned along said support portion fold line, and wherein a first one of said opening edges includes a central wave crest that is flanked on either side by troughs, and the other of said opening edges has generally the opposite shape of said first opening edge, such that the second opening edge has a central trough that is flanked on either side by wave crests.

3. The gift card presenter of claim 2, wherein said support portion fold line and said base portion fold line are aligned.

4. The gift card presenter of claim 3, wherein said support portion includes a line of weakening on said support portion fold line.

5. The gift card presenter of claim 4, wherein a flange portion at each of said ends of said support portion is secured to said inner surface of said base portion, said flange portions each having an inner edge, wherein said support portion includes the line of weakening along each of said inner edges.

6. The gift card holder of claim 5, wherein said support portion is adapted to fold along said lines of weakening to allow said base portion to fold closed.

7. The gift card presenter of claim 1, wherein said support portion limits the range of folding motion of said base portion.

8. The gift card holder of claim 7, wherein said support portion allows said base portion to unfold until said base portion is generally flat.

9. The gift card presenter of claim 1, wherein said opening is adapted to receive said card in at least one of a horizontal and vertical orientation.

10. The gift card presenter of claim 1, wherein said base portion fold line runs transversely across the width of said base portion and divides said base portion into two generally equal halves.

11. The gift card presenter of claim 1, wherein at least one of said base portion and said support portion includes printing thereon.

12. A gift card presenter, comprising:

a single sheet having first, second, third, fourth and fifth fold lines and having an inner and outer surface, said single sheet having a first free end adjacent said first fold line and a second opposite free end adjacent said fifth fold line, wherein a portion of said sheet between said first free end and said second fold line defines a base portion;

wherein a portion of said sheet between said second and third fold lines is folded along said second fold line to overlap said inner surface of said base portion, said overlapped portion being secured to said inner surface of said base portion;

wherein a portion of said sheet between said fifth fold line and said second free end is secured to said inner surface of said base portion between said first fold line and said first end, wherein said portion of the sheet between the fifth fold line and the second free end is shorter than the inner surface of the base portion between the fifth fold line and the first free end;

wherein a portion of said sheet between said third and fifth fold lines forms a support portion, wherein said support portion defines an opening adapted to receive and support a card, wherein said card is adapted to travel through said opening and engage said base portion; and wherein said support portion unfolds and travels toward said base portion when said base portion is unfolded, wherein said base portion forces said card to move at least partially out of said opening and outward from said support portion;

wherein said opening includes a pair of edges that cooperate with each other to securely retain said card between said edges, each said edge having a continuously curving wave-shape.

13. The gift card presenter of claim 12, wherein said first fold line and said fourth fold line are aligned.

14. The gift card presenter of claim 13, wherein said opening is positioned along said fourth fold line.

15. The gift card presenter of claim 14, wherein at least one of said third, fourth and fifth fold lines includes a line of weakening.

16. The gift card presenter of claim 15, wherein said line of weakening is at least one of a perforation and a living hinge.

17. The gift card presenter of claim 15, wherein said first, second, third, fourth and fifth fold lines are oriented transversely across a width of said sheet.

18. A method for forming a card holder, comprising:

providing a sheet having first, second, third, fourth and fifth fold lines and having an inner and outer surface, the sheet having a first free end adjacent said first fold line and a second opposite free end adjacent said fifth fold line, wherein a portion of the sheet between the first free end and the second fold line defines a base portion;

folding a portion of the sheet between the second and third fold lines along the second fold line to overlap the inner surface of the base portion and securing the overlapped portion to the inner surface of the base portion;

securing a portion of the sheet between the fifth fold line and the second free end to the inner surface of the base portion between the first fold line and the first free end, wherein said portion of the sheet between the fifth fold line and the second free end is shorter than the inner surface of the base portion between the fifth fold line and the first free end, wherein a support portion is defined between the third and fifth fold lines;

forming an opening in the support portion that is adapted to receive and support a card, said opening having a wave-shape adapted to securely retain a card within said opening;

inserting a card through the opening until the card engages the base portion; and unfolding the base portion, wherein the unfolding motion of the base portion forces the card back through the opening.

19. The method of claim 18, further comprising folding the base portion closed, wherein the support portion collapses along the third, fourth and fifth fold lines when the base portion is folded.

* * * * *